US006348756B1

(12) United States Patent
Gärtner et al.

(10) Patent No.: US 6,348,756 B1
(45) Date of Patent: Feb. 19, 2002

(54) ELECTRIC DISCHARGE TUBE OR DISCHARGE LAMP AND SCANDATE DISPENSER CATHODE

(75) Inventors: Georg Gärtner; Peter Geittner, both of Aachen; Ernst Klein, Roetgen, all of (DE)

(73) Assignee: U.S. Philips Corporation, New York, NY (US)

( * ) Notice: Subject to any disclaimer, the term of this patent is extended or adjusted under 35 U.S.C. 154(b) by 474 days.

(21) Appl. No.: 08/688,423

(22) Filed: Jul. 30, 1996

(30) Foreign Application Priority Data

Jul. 31, 1995 (DE) ..... 195 27 723

(51) Int. Cl.[7] ..... H01J 1/28
(52) U.S. Cl. ..... 313/346 R; 313/337; 313/270
(58) Field of Search ..... 313/346 R, 346 DC, 313/337, 270

(56) References Cited

U.S. PATENT DOCUMENTS 4,570,099 A * 2/1986 Green ..... 313/346 R
4,594,220 A * 6/1986 Hasker et al. ..... 313/346 R X
4,823,044 A * 4/1989 Falce ..... 313/346 R
4,855,637 A * 8/1989 Watanabe et al. ..... 313/446 R
4,904,896 A * 2/1990 Chiang ..... 313/346 R X
4,928,034 A * 5/1990 Kimura et al. ..... 313/346 R
5,138,224 A * 8/1992 Goldberg et al. .... 313/346 R X

FOREIGN PATENT DOCUMENTS

EP 0317002 B1 5/1989 ..... H01J/1/28
EP 0549034 A1 6/1993 ..... H01J/1/28

* cited by examiner

*Primary Examiner*—Ashok Patel

(57) ABSTRACT

An electric discharge tube or discharge lamp comprising a scandate dispenser cathode which is composed of a cathode body and a coating having an emissive surface, said cathode body including a matrix of at least one refractory metal and/or a refractory alloy and a barium compound which is in contact with the matrix material to supply barium to the emissive surface by means of a chemical reaction with said matrix material, and the coating containing one or more multilayers which may include a bottom layer of tungsten and/or a tungsten alloy, an intermediate layer of rhenium and/or a rhenium alloy and a top layer of scandium oxide, a mixture of scandium oxide and rare-earth metal oxides, a scandate and/or a scandium alloy, is characterized by a long service life and a high emission-current density.

8 Claims, 1 Drawing Sheet

ELECTRIC DISCHARGE TUBE OR DISCHARGE LAMP AND SCANDATE DISPENSER CATHODE

BACKGROUND OF THE INVENTION

Figure 1:
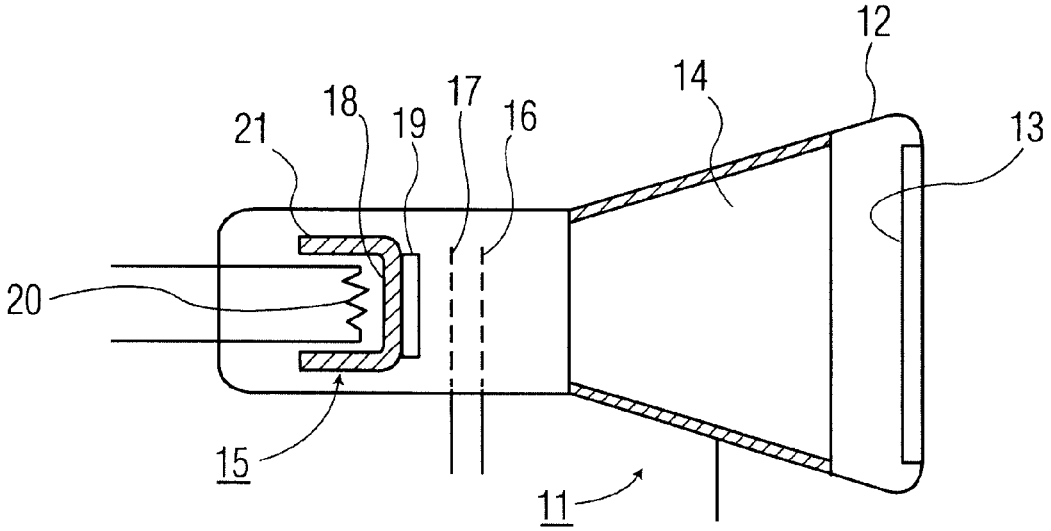

The invention relates to an electric discharge tube, in particular a vacuum tube, or to a discharge lamp, in particular a low-pressure gas-discharge lamp, comprising at least one scandate dispenser cathode which is composed of a cathode body and a coating having an emissive surface, said cathode body including a matrix of at least one refractory metal and/or a refractory alloy and a barium compound which is in contact with the matrix material to supply barium to the emissive surface by means of a chemical reaction with said matrix material. The invention further relates to such a scandate dispenser cathode.

Electron tubes, in particular vacuum tubes, are used predominantly as display tubes in television receivers, as monitor tubes, X-ray tubes, high-frequency tubes and microwave tubes for various applications in any field of machine and installation construction, in medical technology, in diagnostic and measuring devices in workshops as well as in electronic games.

Television and monitor tubes must meet ever higher requirements as regards brightness, resolution, constant picture quality and long-term operating performance. To obtain a higher brightness and a better resolution of the electron beam, higher electron-emission current densities in the tubes are necessary, which can only be achieved by means of improved electron sources, i.e. cathodes. In the middle of the 1980s the requirements could be met by standard oxide cathodes having a long-term emission-current density of 2 $A/mm^2$, whereas currently 10 $A/mm^2$ are required, while much higher emission-current densities are required for the novel high-performance tubes.

Virtually the same applies to the emission-current density and long-term stability of X-ray tubes, high-frequency tubes and microwave tubes.

The emission-current density at a cathode is governed, in accordance with the Richardson equation $$I_0 = A_R T^2 \exp(-\phi/kT)$$

by the work function at the cathode surface $\phi$ and by the operating temperature T.

At a constant operating temperature T, a cathode can produce a higher

At a constant operating temperature T, a cathode can produce a higher emission-current density as its work function $\phi$ is lower. Alternatively, at a constant current density, a cathode can be operated at lower temperatures as its work function $\phi$ is lower. A lower operating temperature has a positive effect on the service life of the cathode and the discharge tube.

At present, the cathodes having the highest electron emission are scandate dispenser cathodes. The two most important types of scandate dispenser cathodes are the "mixed matrix scandate cathode' and the "top layer scandate cathode". The "mixed matrix scandate cathode" is composed of a porous cathode body which is made from tungsten and scandium oxide and which is impregnated with 4 $BaO.CaO.Al_2O_3$. "Top layer scandate cathodes" are composed of a porous tungsten body which is impregnated with 4 $BaO.CaO.Al_2O_3$ and which is covered with a thin coating of tungsten and scandium oxide or $SC_2W_3O_{12}$.

During operation of the cathode, a surface complex is formed as a result of a chemical reaction between tungsten, scandium oxide and barium-calcium-aluminate, which surface complex brings about and maintains the high electron emission. As this surface complex is destroyed by the ion bombardment in the tube, it must be recovered constantly. However, scandium oxide is not very mobile, so that the segregation of scandium to form the surface complex is disturbed and the cathode emission during operation of the discharge tube or discharge lamp decreases rapidly. To overcome this drawback, it was proposed in EP 0 317 002 to use scandium-containing metal compounds or alloys which are a compound of scandium and one or more of the metals rhenium, ruthenium, hafnium, nickel, cobalt, palladium, zirconium or tungsten to bring about scandium segregation in the surface of the cathode. The long-term behavior of the cathodes in accordance with EP 0317002 is improved, but the reproducibility of the results is insufficient.

Further, EP 0549034 discloses a cathode comprising a matrix body which is impregnated with an alkaline-earth compound and on the surface of which a coating is provided which contains a refractory metal such as, in particular, tungsten and scandium. A high emission at a low operating temperature as well as a quick recovery after ion bombardment and a long service life are obtained in that the coating comprises at least two layers of a different composition, one layer of a pure metal being applied to the impregnated matrix body, said layer containing scandium as well as a metal having a high melting point such as, in particular, tungsten and/or rhenium, and in that a top coating of a metal having a high melting point such as, in particular, tungsten is applied. These cathodes are preferably manufactured by means of a method in which first pure-metal layers of scandium and/or rhenium are manufactured by means of, in particular, a plasma-activated CVD process, preferably by means of a plasma produced by direct-current glow discharge, whereafter the final layer, being a metallic tungsten layer, is provided by means of a CVD process. However, cathodes of this type have a low emission-current density.

OBJECTS AND SUMMARY OF THE INVENTION

Therefore, it is an object of the invention to provide an electric discharge tube or discharge lamp, which yields high emission-current densities over a long period of time in a reproducible manner.

In accordance with the invention, this object is achieved by an electric discharge tube or discharge lamp having at least one scandate-dispenser cathode, which is composed of a cathode body and a coating having an emissive surface, said cathode body comprising a matrix of at least one refractory metal and/or a refractory alloy and a barium compound which is in contact with the matrix material to supply barium to the emissive surface by means of a chemical reaction with said matrix material, and the coating containing one or more multilayers which may include a bottom layer of tungsten and/or a tungsten alloy, an intermediate layer of rhenium and/or a rhenium alloy and a top layer of scandium oxide, a mixture of scandium oxide and rare-earth metal oxides, a scandate and/or a scandium alloy.

Such a discharge tube or discharge lamp has a long service life because it has a good resistance to ion bombardment in doses up to several $10^{19}$ ions/$mm^2$. Such a discharge tube or discharge lamp can for example be used as a high-resolution computer monitor (CMT), in high-resolution television receivers having a display screen aspect ratio of 16:9 and as high-performance X-ray tubes, because it attains a saturation emission-current density $i_0 \leqq 25$ A/cm$^2$ at 965° C., which is the measured radiation temperature of the molybdenum cap of the cathode holder.

Another aspect of the invention relates to a scandate dispenser cathode which is composed of a cathode body and a coating having an emissive surface, said cathode body comprising a matrix of at least one refractory metal and/or a refractory alloy and a barium compound which is in contact with the matrix material to supply barium to the emissive surface by means of a chemical reaction with the matrix material, and the coating comprises one or more multilayers which may include a bottom layer of tungsten and/or a tungsten alloy, an intermediate layer of rhenium and/or a rhenium alloy and a top layer of scandium oxide, a mixture of scandium oxide and rare-earth metal oxides, a scandate and/or a scandium alloy.

The scandate dispenser cathode in accordance with the invention exhibits low tungsten losses and the scandium dispensation in the emissive surface is not passivated during operation of the cathode. The layer structure precludes the diffusion of oxygen towards tungsten.

A scandate dispenser cathode in accordance with the invention, in which the cathode body comprises a scandium compound or a scandium alloy to dispense scandium to the emissive surface, has a very long service life.

Preferably, the multilayer is made of ultrafine particles. Scandate dispenser cathodes having a coating of ultrafine particles have surface structures and surface modulations of particles whose diameter ranges from 1 to 100 nm and hence relatively small radii of curvature in a dense particle and microtip distribution on the macroscopic surface.

Preferably, the multilayer in the coating of the scandate dispenser cathode in accordance with the invention is manufactured by means of laser-ablation deposition. Unlike well-known wet-chemical processes, laser-ablation deposition involves short reaction times. In addition, unlike well-known evaporation methods, the grain-size distribution of the ultrafine particles can be easily controlled.

It is further preferred that the bottom layer, intermediate layer and top layer each have a thickness in the range from 5 to 150 nm. Scandate dispenser cathodes having such layers exhibit excellent emissive properties.

It is particularly preferred that the coating of the scandate dispenser cathodes in accordance with the invention has a thickness in the range from 50 to 1,000 nm, preferably 400 to 600 nm. In this manner, a cathode having a service life of 10,000 h is obtained.

FIG. 1 depicts an electric discharge Tube.

DETAILED DESCRIPTION OF THE PREFERRED EMBODIMENTS

These and other aspects of the invention will be apparent from and elucidated with reference to the embodiments described hereinafter.

An electric discharge tube or discharge lamp is composed of four functional groups, namely electron-beam generation, beam focusing, beam deflection and the fluorescent screen.

The electron-beam generating system of the discharge tubes or discharge lamps in accordance with the invention comprises an arrangement which is composed of one or more dispenser cathodes. For example, said electron-beam generating system may be one or more punctiform cathodes or a system composed of one or more wire cathodes, flat-strip cathodes or planar cathodes. Wire cathodes, flat-strip cathodes and planar cathodes do not have to emit throughout their surface area, they may alternatively contain the emissive dispenser-cathode arrangement only in individual surface segments.

A dispenser cathode in accordance with the invention comprises a cathode body and a coating. Said cathode body includes a matrix of at least one metal having a high melting point and/or an alloy having a high melting point and a barium compound which is in contact with the matrix material to supply barium to the emissive surface by means of a chemical reaction with the matrix material.

Cathode bodies which can suitably be used in the invention are known dispenser cathodes such as L cathodes, M cathodes and I cathodes as well as mixed-matrix cathodes.

Cathodes which can particularly suitably be used as cathode bodies are I cathodes and mixed-matrix cathodes.

The coating of the cathodes in accordance with the invention comprises one or more multilayers which may include a bottom layer of tungsten and/or a tungsten alloy, an intermediate layer of rhenium and/or a rhenium alloy and a top layer of scandium oxide, a mixture of scandium oxide and rare-earth metal oxides, a scandate and/or a scandium alloy. The overall thickness of the top coating is chosen to be such that the cathode has an appropriate service life. The service life of dispenser cathodes is limited, inter alia, as a result of erosion by sputter reactions at the cathode surface. Said sputter reaction involves ions which are formed, by the electron beam, from the residual gases in the vacuum of the discharge tube or discharge lamp. The applied voltage causes these ions to be accelerated, so that they impinge on the cathode and cause erosion of its surface. This erosion process as a result of ion bombardment can be simulated by means of an ion gun and the erosion rate can be determined. This erosion rate is used to estimate the overall thickness of the coating. In general, the overall thickness of the coating will range from 600 to 1,000 nm.

The individual layers of the multilayer, i.e. the bottom layer comprising tungsten, the intermediate layer of rhenium and the top layer comprising scandium oxide or a scandium alloy, should preferably be very thin. The mass-equivalent thickness of the scandium layer should preferably be in the nanometer range between 5 and 20 nm, the mass-equivalent thickness of the tungsten-containing layer and of the rhenium-containing layer should preferably range between 20 and 200 nm. The mass-equivalent layer thicknesses are determined by means of the theoretical densities and the basic weights of the coating materials provided. These very thin individual layers bring about an improved bond between the individual phases and hamper the grain growth as a result of sintering during operation. The layers then have a nanostructure, that is they consist of individual piles of particles which are separated by large, predominantly open pores. As a result, the coating has a slightly discontinuous, radially and laterally structured surface. When the particles of the bottom layer, intermediate layer and top layer are deposited successively, their nanostructures interlock thereby combining the materials in such a manner in the coating that said combination has excellent emissive properties.

If the dispenser cathode in accordance with the invention comprises only a single multilayer, the lower layer, which comprises tungsten, can alternatively be formed by the tungsten-containing matrix of the cathode body.

The scandium-containing top layer can be made from scandium oxide $Sc_2O3$ or scandium oxide, which is mixed with the oxides of other rare-earth metals such as europium, samarium and cerium, or from scandates such as alkaline-earth scandates. It is alternatively possible to use scandium-containing alloys and/or intermetallic compounds such as $Re_{24}Sc_5$, $Re_2Sc$, $Ru_2Sc$, $Co_2Sc$, $Pd_2Sc$ and $Ni_2Sc$. However, these compounds, compound mixtures or alloys should not contain tungsten.

Metallic rhenium is used as the material for the rhenium-containing intermediate layer.

As the material for the lower layer use is made of tungsten or a tungsten alloy containing osmium, iridium, ruthenium, tantalum and/or molybdenum.

The method of manufacturing the dispenser cathode in accordance with the invention comprises two steps. In the first step, the cathode body is manufactured, and in the second step, the emissive coating is provided on said cathode body. Preferably, conventional I cathodes or mixed-matrix cathodes are used as the cathode bodies.

I cathodes are impregnated dispenser cathodes. They are composed of a porous tungsten matrix which is powder-metallurgically manufactured from tungsten powder. This porous matrix is impregnated with a mixture of BaO, CaO and $Al_2O_3$. For this purpose, a mixture of $BaCO_3$, $CaCO_3$ and $Al_2O_3$ is melted, and the porous matrix is filled with said mixture by infiltration of the melt. Subsequently, any oxide mixture adhering to the external surface of the body is removed by ultrasound and water.

Mixed-matrix cathodes comprise scandium in a common matrix of tungsten and scandium oxide. Said matrix is manufactured by sintering a powder mixture of tungsten and scandium oxide, the sinter process being conducted so that a porous body is formed. This porous sintered body is impregnated with a mixture of BaO, CaO and $Al_2O_3$ in the same manner as the I cathodes. The cleaning and activating processes are also the same.

The coating can be manufactured by means of conventional coating processes. Said processes include CVD, PCVD and sputtering. However, within the scope of the invention, the individual layers of the coating, which consist of ultrafine particles, are preferably manufactured by means of laser-ablation deposition.

To this end, the cathode body is introduced into the deposition chamber of a laser-ablation deposition device. Good results are obtained when use is made of an excimer laser which, unlike $CO_2$ lasers, can also ablate tungsten without any problem. In succession, the tungsten-containing layer, the rhenium-containing layer and the scandium-containing layer are deposited. Favorable results are obtained by using multitargets containing all three components on one target arrangement. The emissive properties of the finished scandate dispenser cathode are favorably influenced when, during the ablation process, the gas atmosphere consists of very pure argon or argon/hydrogen. It may also be favorable to heat the substrates (cathode bodies) for the coating during the ablation-deposition process. The conditions for the laser-ablation deposition process are set so as to obtain ultrafine particles whose grain size is in the average to high range.

In general, the emissive surface of the cathode is activated in a further process step.

EXAMPLE 1

An I-cathode body is manufactured in the form of a porous pellet by sintering tungsten powder at 1,500° C. in a hydrogen atmosphere to form a cylindrical body having a diameter of 1.8 mm and a height of 0.5 mm, and impregnating it with 7 wt. % barium-calcium-aluminate powder of the composition 4BaO—CaO—$Al_2O_3$. Said pellet is put in a molybdenum cup and introduced into the ablation chamber of a laser-ablation deposition apparatus. For the target use is made of a cylindrical multitarget containing $SC_2O_3$, rhenium and tungsten. The laser is an UV-excimer laser having a wavelength of 248 nm and an average power of 100 W, which brings about cold ablation on the rotating target. For the carrier gas use is made of a mixture of highly pure argon and hydrogen. The overall pressure in the ablation chamber is 1 mbar. During said ablation, the multitarget is translated and the three sub-regions of the target are continuously scanned in the following order: tungsten, rhenium, scandium oxide. To fix the coating, the tungsten pellets are heated to 800° C. during the coating process.

The ablation-deposition process is continued until a mass-equivalent overall layer thickness of 600 nm is attained.

The pellet with the coating in accordance with the invention is welded onto a cathode shaft comprising a heater spiral. This indirectly heatable cathode and other components, such as radiation cylinders and ceramic insulation, are assembled to form a cathode unit. Three of these units are incorporated in each color-television tube.

The measured emission-current density of the cathode was 120 A/cm$^2$ at a cathode temperature of 950° C.

EXAMPLE 2

An I-cathode body is manufactured in the form of a porous pellet by sintering tungsten powder at 1,500° C. in a hydrogen atmosphere to form a cylindrical body having a diameter of 1.8 mm and a height of 0.5 mm, and impregnating it with 7 wt. % barium-calcium-aluminate powder of the composition 4BaO—CaO—$Al_2O_3$. Said pellet is put in a molybdenum cup and introduced into the ablation chamber of a laser-ablation deposition apparatus. For the target use is made of a cylindrical multitarget containing $Sc_2O_3$, and rhenium. The laser is an UV-excimer laser having a wavelength of 248 nm and an average power of 100 W, which brings about cold ablation on the rotating target. For the carrier gas use is made of a mixture of highly pure argon and hydrogen. The overall pressure in the ablation chamber is 1 mbar. Each time an Re layer having a mass-equivalent layer thickness of 120 nm and a scandium-oxide layer having a mass-equivalent layer thickness of 20 nm are deposited. This layer sequence is repeated five times. To fix the coating, the tungsten pellets are heated to 800° C. during the coating process.

The pellet with the coating in accordance with the invention is welded onto a cathode shaft comprising a heater spiral. This indirectly heatable cathode and other components, such as radiation cylinders and ceramic insulation, are assembled to form a cathode unit. Three of these units are incorporated in each color-television tube.

The measured emission-current density of the cathode was 25 A/cm$^2$ at a cathode temperature of 980° C.

What is claimed is:

1. An electric discharge tube having a scandate dispenser cathode, which is composed of a cathode body and a coating having an emissive surface, said cathode body comprising a matrix material of at least one refractory metal or at least one refractory alloy and a barium compound which is in contact with the matrix material to supply barium to the emissive surface by means of a chemical reaction with said matrix material, said coating containing a multilayer which includes a bottom layer of tungsten or a tungsten alloy, an intermediate layer of rhenium or a rhenium alloy and a top layer of scandium oxide, a mixture of scandium oxide and rare-earth metal oxides, a scandate or a scandium alloy.

2. A scandate dispenser cathode which is composed of a cathode body and a coating having an emissive surface, said cathode body comprising a matrix material of at least one refractory metal or at least one refractory alloy and a barium compound which is in contact with the matrix material to supply barium to the emissive surface by means of a chemical reaction with the matrix material, and the coating containing a multilayer which includes a bottom layer of tungsten or a tungsten alloy, an intermediate layer of rhenium or a rhenium alloy and a top layer of scandium oxide, a mixture of scandium oxide and rare-earth metal oxides, a scandate or a scandium alloy.

3. A scandate dispenser cathode as claimed in claim 2, characterized in that the cathode body comprises a scandium compound or a scandium alloy to dispense scandium to the emissive surface.

4. A scandate dispenser cathode as claimed in claim 2, characterized in that the multilayer is composed of ultrafine particles.

5. A scandate dispenser cathode as claimed in claim 3, characterized in that the multilayer is manufactured by means of laser-ablation deposition.

6. A scandate dispenser cathode as claimed in claim 3, characterized in that the bottom layer, intermediate layer and top layer each have a thickness in the range from 5 to 150 nm.

7. A scandate dispenser cathode as claimed in claim 3, characterized in that the top coating has a thickness in the range from 50 to 1,000 nm.

8. A scandate dispenser cathode as claimed in claim 7 characterized in that the top coating has a thickness in the range from 400 to 600 nm.

* * * * *